US010632479B2

(12) United States Patent
Yao et al.

(10) Patent No.: US 10,632,479 B2
(45) Date of Patent: Apr. 28, 2020

(54) DROPLET GENERATOR BASED ON HIGH ASPECT RATIO INDUCED DROPLET SELF-BREAKUP

(71) Applicant: The Hong Kong University of Science and Technology, Hong Kong (CN)

(72) Inventors: Shuhuai Yao, Hong Kong (CN); Hongbo Zhou, Shanghai (CN); Xiaonan Xu, Hong Kong (CN); Jianjie Lu, Hong Kong (CN)

(73) Assignee: The Hong Kong University of Science and Technology, Hong Kong (CN)

( * ) Notice: Subject to any disclaimer, the term of this patent is extended or adjusted under 35 U.S.C. 154(b) by 0 days.

(21) Appl. No.: 15/547,763

(22) PCT Filed: May 20, 2016

(86) PCT No.: PCT/IB2016/000801

§ 371 (c)(1),
(2) Date: Jul. 31, 2017

(87) PCT Pub. No.: WO2016/189383

PCT Pub. Date: Dec. 1, 2016

(65) Prior Publication Data

US 2018/0085762 A1 Mar. 29, 2018

Related U.S. Application Data

(60) Provisional application No. 62/179,927, filed on May 22, 2015.

(51) Int. Cl.
*B05B 1/10* (2006.01)
*B01L 3/00* (2006.01)
(Continued)

(52) U.S. Cl.
CPC ..... *B05B 1/10* (2013.01); *B01F 13/0069* (2013.01); *B01F 13/0071* (2013.01);
(Continued)

(58) Field of Classification Search
CPC ..... B05B 1/10; B05B 12/082; B01L 3/50278; B01L 2300/061; B01L 2300/0867;
(Continued)

(56) References Cited

U.S. PATENT DOCUMENTS 4,596,364 A * 6/1986 Bauer ..... A46B 11/00 239/589.1
5,810,988 A * 9/1998 Smith, Jr. ..... B05B 17/0607 204/666
(Continued)

FOREIGN PATENT DOCUMENTS

CN 1237119 A 12/1999
CN 101132853 A 2/2008
(Continued)

OTHER PUBLICATIONS

Anna, S. L. et al., Formation of dispersions using "flow focusing" in microchannels, Applied Physics Letters, Jan. 20, 2003, 82(3):364-366, 2003 American Institute of Physics.
(Continued)

*Primary Examiner* — Alex M Valvis
*Assistant Examiner* — Joseph A Greenlund
(74) *Attorney, Agent, or Firm* — Saliwanchik, Lloyd & Eisenschenk

(57) ABSTRACT

A droplet generator apparatus and droplet generation method based on high aspect ratio induced droplet self-breakup are provided. The droplet generator apparatus includes a channel (1) and a nozzle (2) connected to the channel(1), and the
(Continued)

aspect ratio of the channel (1) can be 3.0 or greater. The apparatus may further include a blocking rail (10) that is positioned in front of the nozzle (2), a supplying rail(9) that is positioned in front of the nozzle (2), and a supplying trench (8) formed in a space between the nozzle (2) and the supplying rail (9).

18 Claims, 3 Drawing Sheets

(51) Int. Cl.
*B01F 13/00* (2006.01)
*B05B 12/08* (2006.01)

(52) U.S. Cl.
CPC ..... *B01F 13/0072* (2013.01); *B01L 3/502784* (2013.01); *B01L 2300/0681* (2013.01); *B01L 2300/0867* (2013.01); *B05B 12/082* (2013.01); *Y10T 436/2575* (2015.01)

(58) Field of Classification Search
CPC ..... B01L 2200/0673; B01L 2400/0487; B01F 13/0069; B01F 13/0071; B01F 13/0072; B01F 3/0807; B01F 13/0062; Y10T 436/2575
USPC ..... 239/589; 422/502–504; 436/180
See application file for complete search history.

(56) References Cited

U.S. PATENT DOCUMENTS 6,189,813 B1* 2/2001 Skeath ..... B05B 1/02 239/424.5
6,633,031 B1* 10/2003 Schultz ..... G01N 30/7266 210/198.2
6,911,132 B2* 6/2005 Pamula ..... B01F 11/0071 204/600
7,294,503 B2* 11/2007 Quake ..... G01N 15/1459 435/288.5
7,943,671 B2* 5/2011 Herminghaus ..... B01F 3/0807 204/228.1
8,323,466 B2* 12/2012 Kim ..... B01L 3/502761 204/403.01
8,567,425 B2* 10/2013 Tan ..... B01L 3/5027 137/3
8,592,221 B2* 11/2013 Fraden ..... F17D 1/12 436/180
8,597,729 B2* 12/2013 Fournier-Bidoz ..... C40B 20/04 239/10
8,765,454 B2* 7/2014 Zhou ..... B01L 3/5027 422/502
8,968,659 B2* 3/2015 Davies ..... B01F 5/0057 422/50
9,038,919 B2* 5/2015 Link ..... B01F 5/0682 239/3
9,126,160 B2 9/2015 Ness et al.
10,357,771 B2* 7/2019 Bharadwaj ..... C12Q 1/6806
2001/0001474 A1* 5/2001 Moon ..... G01N 30/6095 239/3
2002/0158027 A1* 10/2002 Moon ..... G01N 30/6095 210/756
2003/0054558 A1* 3/2003 Kurabayashi ..... G01N 15/1404 436/63
2003/0121995 A1* 7/2003 Akahane ..... B41J 2/14274 239/548
2005/0172476 A1* 8/2005 Stone ..... B01F 3/0807 29/592.1
2006/0051329 A1* 3/2006 Lee ..... B01F 3/0807 424/93.7
2006/0120213 A1* 6/2006 Tonkovich ..... B01F 3/0807 366/144
2007/0003442 A1* 1/2007 Link ..... G01N 15/1484 422/400
2007/0054119 A1* 3/2007 Garstecki ..... B01J 19/0093 428/402
2007/0195127 A1* 8/2007 Ahn ..... B01F 13/0071 347/55
2008/0014589 A1 1/2008 Link et al.
2008/0182910 A1 7/2008 Qiu et al.
2009/0098168 A1* 4/2009 Hettiarachchi ..... B01J 13/04 424/400
2009/0266924 A1* 10/2009 Pui ..... B05B 1/14 239/696
2010/0170957 A1* 7/2010 Clarke ..... B01F 3/0807 239/1
2010/0173394 A1* 7/2010 Colston, Jr. ..... B01F 3/0807 435/287.2
2011/0262906 A1* 10/2011 Dimov ..... B01L 3/50273 435/6.1
2012/0075389 A1* 3/2012 Clarke ..... B01F 13/0062 347/73
2012/0153054 A1* 6/2012 Kim ..... B01L 3/0268 239/585.1
2012/0211084 A1* 8/2012 Weitz ..... B01F 3/0807 137/1
2012/0219947 A1* 8/2012 Yurkovetsky ..... B01F 5/0471 435/6.11
2012/0248229 A1* 10/2012 Yang ..... B01F 13/0071 239/690
2012/0322162 A1* 12/2012 Collier ..... B01F 13/0071 436/172
2013/0037634 A1* 2/2013 Miller ..... F02M 19/0228 239/589
2013/0046030 A1* 2/2013 Rotem ..... B01F 3/0807 516/21
2013/0078164 A1* 3/2013 Baroud ..... B67D 3/0058 422/502
2014/0024023 A1* 1/2014 Cauley, III ..... B01L 3/502784 435/6.1
2014/0208832 A1* 7/2014 Hansen ..... G01N 13/00 73/53.01
2014/0220557 A1* 8/2014 Hart ..... G01N 33/4833 435/6.1
2014/0263724 A1* 9/2014 Ovchinnikov ..... B05B 17/0615 239/102.2
2014/0272996 A1* 9/2014 Bemis ..... C12M 47/04 435/6.12
2015/0023546 A1* 1/2015 Strein ..... G10L 19/018 382/100
2015/0129688 A1* 5/2015 Buchanan ..... B23K 26/388 239/589
2015/0174576 A1 6/2015 Van Vilet et al.
2015/0238965 A1* 8/2015 Beer ..... B01F 3/0807 422/505
2015/0298157 A1* 10/2015 Weitz ..... B06B 1/06 239/4
2016/0001289 A1* 1/2016 Hung ..... B01L 3/502784 436/180
2016/0086785 A1* 3/2016 Chiu ..... H01J 49/0445 250/282
2016/0175859 A1* 6/2016 Yi ..... G01F 23/22 239/690
2016/0271513 A1* 9/2016 Weitz ..... B01D 1/18
2016/0271576 A1* 9/2016 Arab ..... C12Q 1/686
2018/0085762 A1* 3/2018 Yao ..... B05B 1/10
2019/0314819 A1* 10/2019 Johnson ..... G01N 33/5008

FOREIGN PATENT DOCUMENTS

CN 101628265 A 1/2010
CN 103464319 A 12/2013
CN 104190570 A 12/2014
JP 2000-168083 A 6/2000

(56) References Cited

FOREIGN PATENT DOCUMENTS

| | | |
|---|---|---|
| JP | 2004-314619 A | 11/2004 |
| WO | WO-0052455 A1 | 9/2000 |

OTHER PUBLICATIONS

Garstecki, P. et al., Formation of droplets and bubbles in a microfluidic T-junction-scaling and mechanism of break-up, *Lab on a Chip*, 2006, 6(3):437-446, The Royal Society of Chemistry 2006.

Nisisako, T. et al., Microfluidic large-scale integration on a chip for mass production of monodisperse droplets and particles, *Lab on a Chip*, 2008, 8(2):287-293, The Royal Society of Chemistry 2008.

Jeong, H. et al., Kilo-scale droplet generation in three-dimensional monolithic elastomer device (3D MED), *Lab on a Chip*, 2015, 15:4387-4392, The Royal Society of Chemistry 2015.

Muluneh, M. et al., Hybrid soft-lithography/laser machined microchips for the parallel generation of droplets, *Lab on a Chip*, 2013, 13(24):4750-4754, The Royal Society of Chemistry 2013.

Kobayashi, I. et al., Novel Asymmetric Through-Hole Array Microfabricated on a Silicon Plate for Formulating Monodisperse Emulsions, *Langmuir*, 2005, 21(17):7629-7632, 2005 American Chemical Society.

Kobayashi, I. et al., Silicon Array of Elongated Through-Holes for Monodisperse Emulsion Droplets, AIChE Journal, Aug. 2002, 48(8):1639-1644.

Kobayashi, I. et al., Preparation characteristics of oil-in-water emulsions using differently charged surfactants in straight-through microchannel emulsification, Colloids and Surfaces A: Physicochem. Eng. Aspects, 2003, 229:33-41, 2003 Elsevier B.V.

Kobayashi, I. et al., Production of Monodisperse Oil-in-Water Emulsions Using a Large Silicon Straight-Through Microchannel Plate, *Ind. Eng. Chem. Res.*, 2005, 44(15):5852-5856, 2005 American Chemical Society.

Sugiura, S. et al., Interfacial Tension Driven Monodispersed Droplet Formation from Microfabricated Channel Array, *Langmuir*, 2001, 17(18):5562-5566, 2001 American Chemical Society.

Sugiura, S. et al., Characterization of Spontaneous Transformation-Based Droplet Formation during Microchannel Emulsification, *J. Phys. Chem. B*, 2002, 106(36):9405-9409, 2002 American Chemical Society.

Kobayashi, I. et al., Microchannel emulsification for mass production of uniform fine droplets: integration of microchannel arrays on a chip, Microfluid Nanofluid, 2010, 8(2):255-262, Springer-Verlag 2009.

International Search Report in International Application No. PCT/IB2016/000801, filed May 20, 2016.

* cited by examiner (a) (b)

DROPLET GENERATOR BASED ON HIGH ASPECT RATIO INDUCED DROPLET SELF-BREAKUP

CROSS-REFERENCE TO RELATED APPLICATIONS

The present application is the U.S. national stage application of International Patent Application No. PCT/IB2016/000801, filed May 20, 2016, which claims the benefit of U.S. Provisional Application Ser. No. 62/179,927, filed May 22, 2015, which are hereby incorporated by reference in their entirety, including any figures, tables, or drawings.

BACKGROUND OF THE INVENTION

Microdroplets have a wide variety of applications. Droplets in microfluidic systems can work as "miniaturized reactors" because of their unique features including high-throughput, minimal reagent consumption, ability to be contamination-free, fast response times, and their ability to isolate individual spaces. Therefore, droplet-based microfluidics has emerged as a potential platform for applications such as chemical and biological assays, synthesis, reactions, drug delivery, and diagnostic testing and screening. A commercialized technology based on microdroplets is digital polymerase chain reactions (dPCR), in which a diluted sample is partitioned into reaction chambers to achieve superior sensitivity and quantification based on single molecule assays. In the past two years, several dPCR instruments based on microdroplet/microwell technology have been developed. It is desirable for these instruments to produce a large number of microdroplets that are uniform in size and small in volume. Although production of millions of microdroplets with a unit volume of a few picoliters (pL) has been demonstrated within half an hour (e.g., with a droplet generation rate of ~5.5 kHz), most of the instruments for producing such microdroplets are expensive and have complex operating schemes.

Conventional methods for producing high volumes of microdroplets generally rely on agitation and sonication methods. However, it is difficult to produce monodispersed (uniform) droplets with such methods because of the spatial heterogeneity of the applied mechanical stress. Another widely adopted industrial method for high-throughput droplet generation is membrane emulsification, in which a dispersed fluid is pressurized and passes through a porous membrane. However, variation of pore diameter in the membrane and mutual interference from adjacent droplets often results in a polydispersed (non-uniform) distribution of generated droplets. Therefore, these two approaches are limited to being used when the droplet quality is not required to be high, such as in food processing or medicine atomization.

Another approach to forming microdroplets is shear-based systems (e.g., T-junction or flow-focusing structures). In these structures, the dispersed phase is squeezed in a main channel, and fractures of the dispersed fluid occur in the continuous phase under the action of shear forces, forming individual microdroplets. Most of the energy in this method is dissipated by the flow of the continuous phase, and a small portion is used to overcome the surface tension of the dispersed phase to generate droplets. It is difficult, if not impossible, to achieve high frequency (e.g., a few kHz) droplet formation from a single unit using this method. In addition, this method makes it difficult to obtain uniform droplet size when many individual droplet forming units are parallelized, because precise pressure and volume control is required for both phases. Therefore, highly uniform droplet generation using this method is difficult, if not impossible, to scale.

Another category of droplet generators is interfacial tension driven systems (e.g., grooved microchannels, edge-based/step emulsification). Only control of the dispersed phase is required for droplet break-up in these systems, which makes parallelization easier. The scalability and compact size of these devices may also provide the potential to further improve droplet generation volume. However, there are still challenges to be addressed in reducing the droplet size, improving the droplet monodispersity (uniformity), minimizing interference between droplet formation units, and stabilizing system dynamics.

BRIEF SUMMARY OF THE INVENTION

Due to the problems discussed above, there is a need in the art for droplet generation methods and apparatuses that are low-cost, parallelizable, scalable, and able to produce uniform droplets at high frequencies. Embodiments of the present invention may include a high-throughput droplet generator for digital polymerase chain reactions (dPCR) or other purposes. Embodiments of the present invention can utilize a high aspect ratio induced droplet self-breakup structure (HIDS) for spontaneous droplet generation. In some embodiments, these structures may be parallelized and event stacked for large scale, high throughput droplet generation. Embodiments of the present invention can be robust because only the dispersed fluid needs to be pressurized, without the need for high precision control. As discussed above, many of the conventional designs require complicated pressure control systems for one or both fluids, which can increase the size and cost of the equipment. In comparison, an exemplified prototype of an embodiment of the present invention can have 300 channels/cm within a 1 $cm^2$ chip that enables 5 kHz generation of 5 pL droplets with a coefficient of variation (CoV) below 5%.

An apparatus for producing droplets according to an embodiment of the present invention can include a channel and a nozzle connected to the channel, wherein the aspect ratio (height of the channel/width of the channel) of the channel is 3.0 or greater. The most basic nozzle may be a simple rectangular opening at the outlet of the channel, with flat walls on each side of the opening. One or more surfactants may be used to stabilize the droplets, and the one or more surfactants may be added to the continuous phase, the dispersed phase, or both the continuous and dispersed phases. The apparatus may further include a blocking rail that is positioned in front of the nozzle, a supplying rail that is positioned in front of the nozzle, and a supplying trench formed in a space between the nozzle and the supplying rail. The channel can further include bends or curves; a filter can be placed before the channel; and the nozzle can include a recess or notch on a side of the channel opening. Instead of a recess or notch on the outlet of the channel, the nozzle may include protrusions on each side of the channel. Furthermore, a chamber suitable for receiving (or configured to receive) droplets can be included and the channel can have an aspect ratio (height of the channel/width of the channel) of 4.0 or greater, 5.0 or greater, 6.0 or greater, 7.0 or greater, 8.0 or greater, 9.0 or greater, or 10.0 or greater.

An apparatus for producing droplets according to an embodiment of the present invention can include a plurality of HIDS structures, wherein each the of HIDS structures includes a channel and a nozzle, and wherein the aspect ratio of each of the channels is 3.0 or greater. The HIDS structures may form a perimeter suitable for containing (or configured to contain) dispersed fluid and allowing dispersed fluid to flow through the HIDS structures. The HIDS structures may form a wall suitable for containing (or configured to contain) a dispersed fluid on one side of the wall and allowing the dispersed fluid to flow through the HIDS structures. A blocking rail, a supplying rail, and a supplying trench may be formed in front of each of the nozzles. The HIDS structures may be vertically stacked and the channels may include curves or bends. The aspect ratio of the channels may be 3.0 or greater, 4.0 or greater, 5.0 or greater, 6.0 or greater, 7.0 or greater, 8.0 or greater, 9.0 or greater, or 10.0 or greater.

A method of producing droplets according to an embodiment of the present invention can include: providing a HIDS structure, wherein the HIDS structure includes a channel and a nozzle, and wherein the aspect ratio of the channel is 3.0 or greater; and passing a dispersed fluid through the channel and out of the nozzle such that droplets are formed in a continuous phase fluid. The method may further include providing one or more additional HIDS structures, each having a channel and a nozzle, and wherein an aspect ratio of each of the additional channels is 3.0 or greater. The method may also include passing the dispersed fluid through the channels and out of the nozzles such that droplets are formed in the continuous phase fluid. The HIDS structures can form a perimeter suitable for containing (or configured to contain) the dispersed fluid or may form a wall suitable for containing (or configured to contain) the dispersed fluid on one side of the wall and allowing it to flow through the HIDS structures and into the continuous phase fluid. The method can further include providing a blocking rail in front of each of the nozzles that repels droplets away from the nozzle and keeps droplets in the continuous phase from interfering with droplets being produced by the nozzles. The method may also include providing a supplying rail and a supplying trench in front of each of the nozzles, wherein the continuous phase fluid flows through the supplying trench to fill space between the droplets. The method may further include providing additional HIDS structures, each having a channel and a nozzle, that are vertically stacked and flowing the dispersed fluid through the additional HIDS structures to form droplets. The method may also include providing curves or bends in the channels, and a chamber suitable for collecting (or configured to collect) droplets that are produced by the HIDS structures may be provided. A chamber may be provided that is suitable for receiving (or configured to receive) droplets produced by the HIDS structures and also suitable for providing (or configured to provide) a flow of continuous phase fluid to carry away droplets produced by the HIDS structures. The method may include producing droplets that range from 10 μm to 100 μm in size and each of the channels may produce droplets with a frequency of 0.5 Hz to 50 Hz. The method may also include providing channels that have an aspect ratio of 3.0 or greater, 4.0 or greater, 5.0 or greater, 6.0 or greater, 7.0 or greater, 8.0 or greater, 9.0 or greater, or 10.0 or greater. One or more surfactants may be used to stabilize the droplets, and the one or more surfactants may be added to the continuous phase, the dispersed phase, or both the continuous and dispersed phases.

BRIEF DESCRIPTION OF THE DRAWINGS

FIG. 1(*b*) is an image showing monodisperse droplet generation from a HIDS structure according to an embodiment of the present invention;

FIG. 2(*b*) is a graph showing droplet generation frequency versus capillary number (Ca) of the dispersed phase;

FIG. 3(*b*) is an image of an experimental embodiment of the present invention that demonstrates concepts illustrated in FIG. 3(*a*);

FIG. 3(*c*) is an image of droplets produced by an embodiment of the present invention that are stabilized and accumulated;

FIG. 4(*b*) is an image showing an embodiment of the present invention that is driven by a pressure pump;

FIG. 5(*b*) is an image of an experimental embodiment of the present invention that demonstrates concepts illustrated in FIG. 5(*a*).

FIG. 6(*b*) is an image of two experimental embodiments of the present invention next to a piece of currency;

FIG. 6(*c*) is an image of an experimental embodiment of the present invention having 800 channels in an integrated microdroplet generator;

FIG. 6(*d*) is an image of an experimental embodiment of the present invention having 164 channels in an integrated microdroplet generator;

FIG. 7(*b*) is an experimental embodiment of the present invention that integrates 1600 channels in two layers of HIDS structures;

FIG. 7(*c*) is an image of demonstrating microdroplet formation using a HIDS structure according to an embodiment of the present invention.

Within the figures, the following annotations are used:

1 Channel;
2 Nozzle;
3 Dispersed Phase Fluid;
4 Continuous Phase Fluid;
5 Chamber;
6 Recess or Notch;
7 Droplets;
8 Supplying Trench;
9 Supplying Rail;
10 Blocking Rail;
11 Inlet Channel;
12 Middle Channel;
13 Outlet Channel;
14 Filter;
15 Dispersed Phase Inlet;
16 HIDS Structures;
17 Droplet Collection Chamber;
18 Screen, Membrane, or Filter;

19 Continuous Phase Outlet;
20 Continuous Phase Flow;
21 Stacked HIDS Structures;
22 Cap;
23 Dispersed Phase Source;
24 Through-hole; and
25 Stackable HIDS Structure.

DETAILED DISCLOSURE OF THE INVENTION

Embodiments of the present invention are based on the inventors' discovery that high aspect ratio rectangular channels are able to induce Rayleigh-Plateau instability of a dispersed fluid thread. This leads to the dispersed fluid thread forming energy favorable spherical drops at the outlet (or nozzle) of a channel. High aspect ratio induced droplet self-breakup (HIDS) is driven by surface tension forces and is able to decouple shear stress interference, making it advantageous for parallel integration on a chip with the ability to produce a high volume of monodispersed (i.e., uniform) droplets. In addition, due to the surface tension driven droplet self-breakup mechanism, HIDS systems only require one pressure source to drive the flow of the dispersed phase. In contrast, conventional structures need to precisely control the flow conditions of both the dispersed and continuous phases. To form droplets in a variety of different sizes, some of the channels may have different aspect ratios. In addition, it should be noted that the HIDS structures are suitable for operating with the dispersed phase being oil based and the continuous phase being water based, and vice versa.

Figure 1:
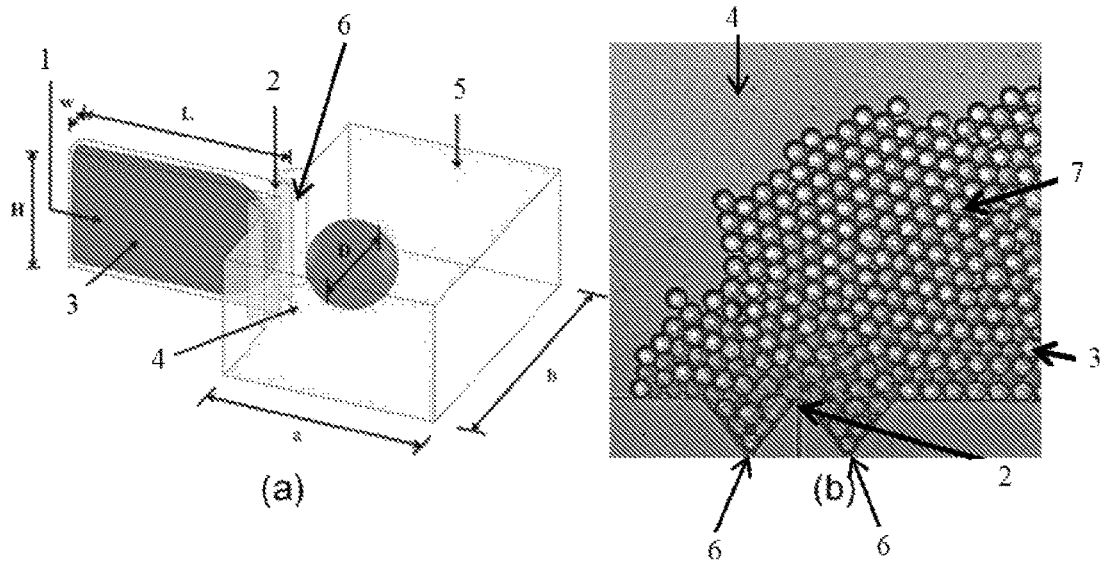
FIG. 1(*a*) is an illustration of a HIDS structure according to an embodiment of the present invention.

FIG. 1(*a*) illustrates the design of a single channel of a high aspect ratio induced droplet self-breakup (HIDS) structure according to an embodiment of the present invention, which will be used to explain the concepts that underpin this technology. The channel 1, nozzle 2, and chamber 5 in this embodiment are uniform in height. High aspect ratio induced droplet self-breakup is accomplished by using a channel with a high aspect ratio, which is defined as the height of the channel H divided by the width of the channel w (H/w). To generate high aspect ratio induced droplet self-breakup, the ratio of height to width of the channel should generally be larger than 3.0 (H/w>3.0), but may be 3.0 or greater, 4.0 or greater, 5.0 or greater, 6.0 or greater, 7.0 or greater, 8.0 or greater, 9.0 or greater, or 10.0 or greater. The length of the channel L, the depth of the chamber a, and the width of the chamber b generally have negligible effect on the droplet self-breakup process when they are substantially greater than the height of the channel H (L, a, b>>H), and thus the device design is more flexible than step emulsification devices. The width of the channel may range, for example, from a few microns to tens of microns. In one embodiment, the channel length/channel width may be 30 or greater and the channel length/channel height may be 10 or greater.

As the interface between the dispersed phase fluid 3 and the continuous phase fluid 4 proceeds along the high aspect ratio channel, the dispersed phase fluid 3 follows the wall geometry in a compressed and energy unfavorable shape. When the dispersed phase fluid 3 arrives at the nozzle 2, the channel 1 confined dispersed phase fluid 3 releases into the continuous phase fluid 4 to form a small spherical protuberance. The curvature of the protuberance continues to decrease as the droplet grows. Provided that the injection flow rate is low and the interface profile evolves in quasi-static state, the inner pressures of the protuberance and the thread equilibrate. However, the curvature of the thread confined in the high aspect ratio nozzle has a minimum value (k*), which is determined by the width of the channel w. When the radius of the protuberance passes the critical value (r*=l/k*), curvature of the protuberance decreases below the minimum curvature of the thread. Due to the Young-Laplace equation, which relates the curvature to the difference between the inner and outer pressure, pressure equilibrium between the thread and the protuberance can no longer be maintained. Unstable inner pressures of the thread drives extra fluid from the thread into the protuberance and triggers necking of the thread, which leads to flow of the continuous phase behind the disperse phase, resulting in droplet formation and separation.

The embodiment depicted in FIG. 1(*a*) also has a recess or notch 6 on each side of the nozzle 2, where the channel 1 meets the chamber 5. However, the most basic nozzle may be a simple rectangular opening, with flat walls on each side of the opening. Also, instead of a recess or notch on the outlet of the channel, the nozzle may include a protrusion on one or both sides of the channel opening. A droplet with a diameter D is shown in the chamber 5, which contains the continuous phase fluid 4. FIG. 1(*b*) is an image showing monodipserse droplet generation from a HIDS structure according to an experimental embodiment of the present invention that is similar to what is illustrated in FIG. 1(*a*). FIG. 1(*b*) shows the generation of droplets 7, which are formed of the dispersed phase fluid 3, in a continuous phase fluid 4. As seen at the bottom FIG. 1(*b*), there is a nozzle 2 that has a recess or notch 6 on both sides.

In HIDS, the interfacial tension is dominant relative to other forces, such as gravitational force, inertial force and viscous force, which may disturb the fluid behavior. By varying the geometry of the nozzle, flow rate of the dispersed phase, viscosity ratio and interfacial tension of the liquids, a series of experiments were conducted to better understand the droplet formation mechanism and a mathematical model was established to predict the resulted droplet size.

Figure 2:
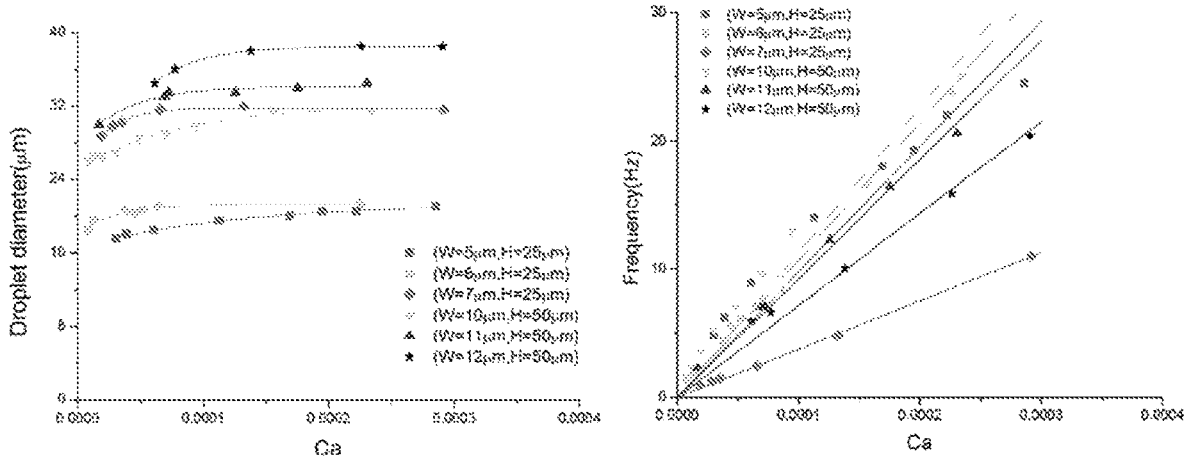
FIG. 2(*a*) is a graph showing droplet diameter versus capillary number (Ca) of the dispersed phase.

FIG. 2(*a*) is a graph showing droplet diameter versus capillary number (Ca) of the dispersed phase for channels with five different aspect ratios. The dimensions of each of the channels (width×height) were 5 μm×25 μm, 6 μm×25 μm, 7 μm×25 μm, 10 μm×50 μm, 11 μm×50 μm, and 12 μm×50 μm, having aspect ratios of 5.0, 4.2, 3.6, 5.0, 4.5, and 4.2, respectively. Referring to FIG. 2(*a*) that there is relatively little change in droplet diameter over the illustrated range of capillary numbers (Ca). Although FIG. 2(*a*) shows droplet diameters ranging from approximately 15 μm to 40 μm, embodiments of the present invention can form droplets ranging from approximately 10 μm to 100 μm, with volumes ranging from approximately 0.5 pL to 500 pL.

FIG. 2(*b*) is a graph showing droplet generation frequency versus capillary number (Ca) of the dispersed phase. The six different channels that are illustrated have the same dimensions and aspect ratios as those illustrated in FIG. 2(*a*). Referring to FIG. 2(*b*), as capillary number (Ca) increases, the frequency or rate of droplet production also increases.

Due to the simplicity of its design, fabrication and operation, HIDS structures are well suited for parallel integration. This can result in the generation of millions of droplets with excellent uniformity in a short period of time. Integrated HIDS structures in parallel can be done with or without crossflow. In addition, in all embodiments of the present invention, one or more surfactants may be used to stabilize the droplets, and the one or more surfactants may be added to the continuous phase, the dispersed phase, or both the continuous and dispersed phases.

Figure 3:
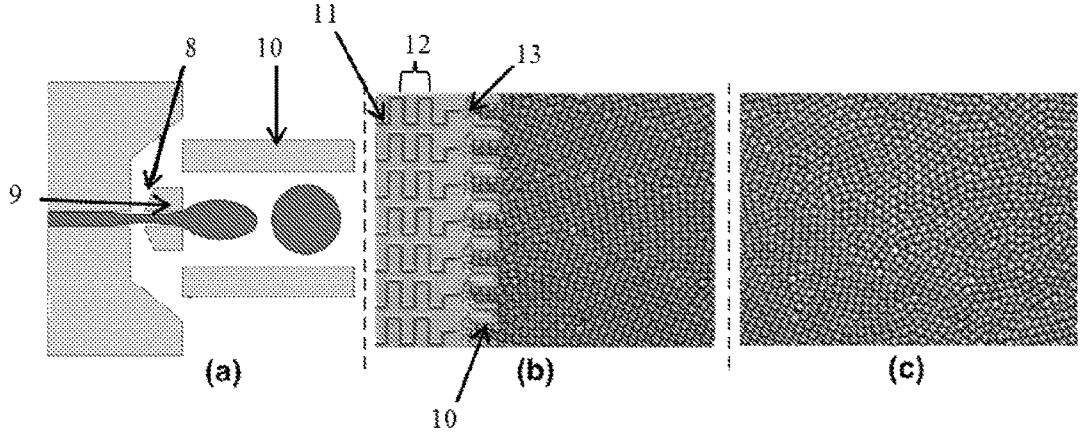
FIG. 3(*a*) is an illustration of an embodiment of the present invention with supporting structures at the nozzle, designed to facilitate droplet removal and supply of continuous phase liquid.

FIG. 3(*a*) is an illustration of an embodiment of the present invention with supporting structures at the nozzle, designed to facilitate droplet removal and supply of continuous phase liquid. The embodiment of FIG. 3(*a*) includes a supplying trench 8, a supplying rail 9, and a blocking rail 10. The blocking rail 10 helps guide the produced droplets away from the nozzle, and may also keep droplets formed by other channels from interfering with droplet formation. The supplying rail 9 creates a space for the supplying trench 8, and allows for the continuous phase fluid to be supplied to the nozzle. The continuous phase fluid can then flow behind the droplets as they are formed and released from the channel, allowing for stable and continuous droplet formation.

FIG. 3(*b*) is an image of an experimental embodiment of the present invention that demonstrates concepts illustrated in FIG. 3(*a*). FIG. 3(*b*) illustrates a series of parallel HIDS structures on the left hand side of the image. Each of the HIDS structures includes a channel that includes an inlet channel 11, a middle channel 12, and an outlet channel 13. The middle channel 12 of this embodiment includes a series of bends or curves, which can increase the length of the channel without widening the width of the structure. The outlet channel 13 may be perpendicular to the nozzle or angled relative to the nozzle (not shown). Blocking rails 10 can also be seen helping to guide produced droplets and keeping droplets produced by other channels from interfering with droplet formation. FIG. 3(*c*) is an image of droplets produced by an embodiment of the present invention, which are stabilized and accumulated in a device chamber. It has been demonstrated that embodiments of the present invention can operate for a prolonged period of time, on the order of days. In addition, experiments have shown that the device can operate more stably when oriented vertically such that the droplets float upwards and away from the nozzles (when the dispersed phase is oil based and the continuous phase is water based).

Figure 4:
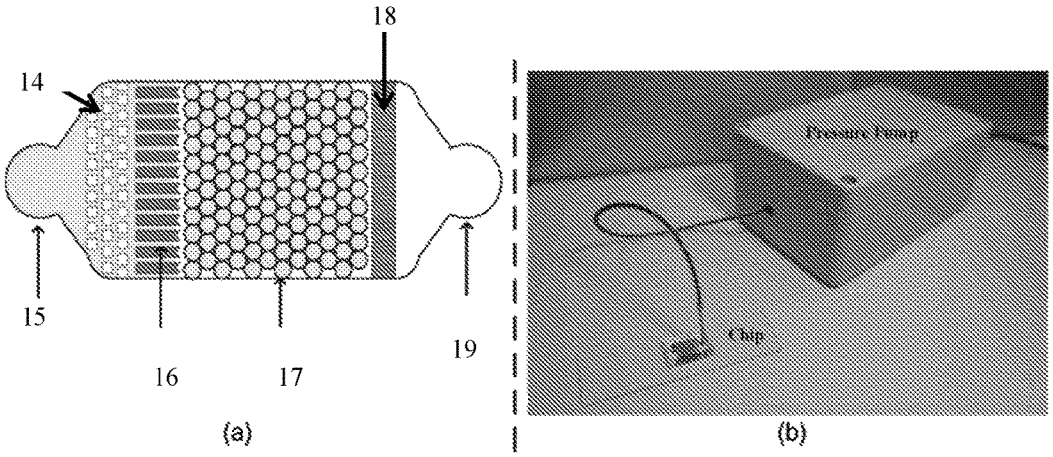
FIG. 4(*a*) is a diagram of parallel HIDS structures and a collection chamber according to an embodiment of the present invention.

FIG. 4(*a*) is a diagram of parallel HIDS structures without cross flow according to an embodiment of the present invention. FIG. 4(*a*) illustrates the production of droplets in a droplet collection chamber 17. The dispersed phase inlet 15 is on the left hand side, and a filter 14 is provided for the dispersed phase fluid to flow through the before passing through a series of parallel HIDS structures 16. As the droplets accumulate in the droplet collection chamber 17, the continuous phase fluid is allowed to flow out of the continuous phase outlet 19, and the droplets are kept in the droplet collection chamber 17 by a screen, membrane, or filter 18. The droplet collection chamber may be the same or substantially the same height as the channels, or may be a different height. A single layer of droplets may be formed in the chamber 17, or more than one layer of droplets may be formed. The chamber 17 may be sealable such that, after droplets have been formed, the chamber can be disconnected from the dispersed phase pressure source and continuous phase outlet and transported as-is for use in a wide variety of industrial, scientific, medical, and diagnostic applications.

One of many applications for the embodiment of FIG. 4(*a*) is a digital polymerase chain reaction (dPCR) droplet generator. The droplets can be stored in the chamber directly and may be formed in a single layer after ejecting from the nozzle. For an example of how such a system may operate, the chip may first be emerged in continuous phase fluid (e.g., oil). The sample can then be loaded and driven by a pressure pump with an operational pressure of only a few psi, as shown in FIG. 4(*b*). Spontaneous droplet break-up takes place at the nozzle of the HIDS structures 16, and the droplet collection chamber 17 is filled. The device can be fabricated using polydimethylsiloxane (PDMS) or other polymers using standard soft photolithography or molding technologies. However, the device may also be fabricated from other materials. The active area of the chip shown in FIG. 4(*b*) is on the order of $cm^2$. After partitioning the sample into thousands or even millions of droplets, the whole chip may then be put on a thermocycler for DNA template replication and observed under a microscope for analysis.

Figure 5:
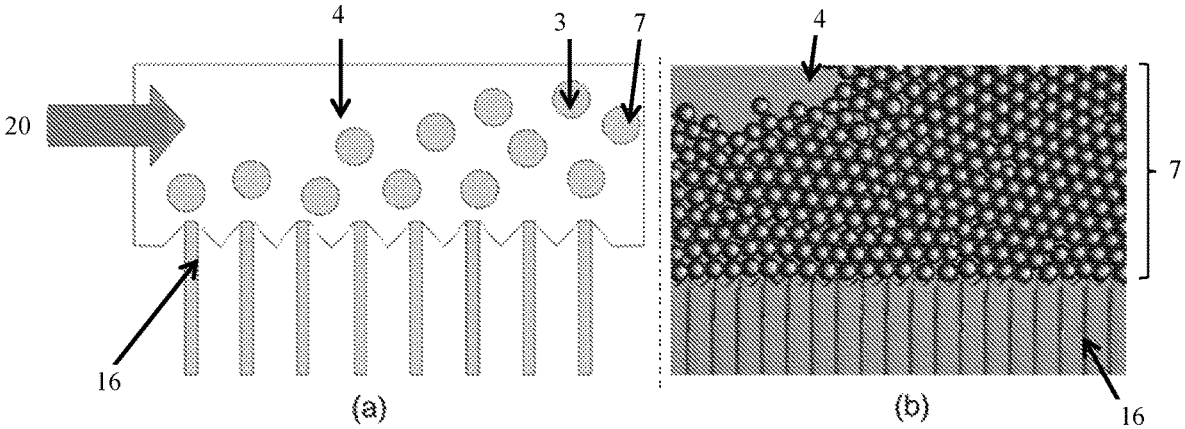
FIG. 5(*a*) is a diagram of parallel HIDS structures with a cross flow of continuous phase fluid according to an embodiment of the present invention.

For applications that require no dead volume or quick stabilization, such as single cell partition and incubation and bacterial growth, the HIDS droplet generator can be incorporated with a cross flow 20 of continuous phase fluid. FIG. 5(*a*) shows a diagram of parallel HIDS structures with cross flow of continuous phase fluid according to an embodiment of the present invention. The HIDS structures can be formed in a parallel line, and the cross flow 20 is able to wash the produced droplets 7 downstream where they can be collected and used for further applications. Washing away the droplets 7 using a cross flow 20 of continuous phase fluid also provides a solution to avoid droplet accumulation at the nozzle. The continuous phase fluid (e.g., oil) should be controlled to flow slowly to minimize the shear stress effects and ensure that the dispersed phase fluid thread breakup into droplets is still governed by surface tension forces. This in turn ensures that the produced droplets are uniform in size. The cross flow of continuous phase fluid can be driven, for example, by an external pressure source, centrifugal force, or capillary effects.

FIG. 5(*b*) is an image of an experimental embodiment of the present invention that demonstrates concepts illustrated in FIG. 5(*a*). HIDS structures are shown at the bottom of the image producing droplets 7 that are removed by the cross flow of continuous phase fluid 4.

Figure 6:
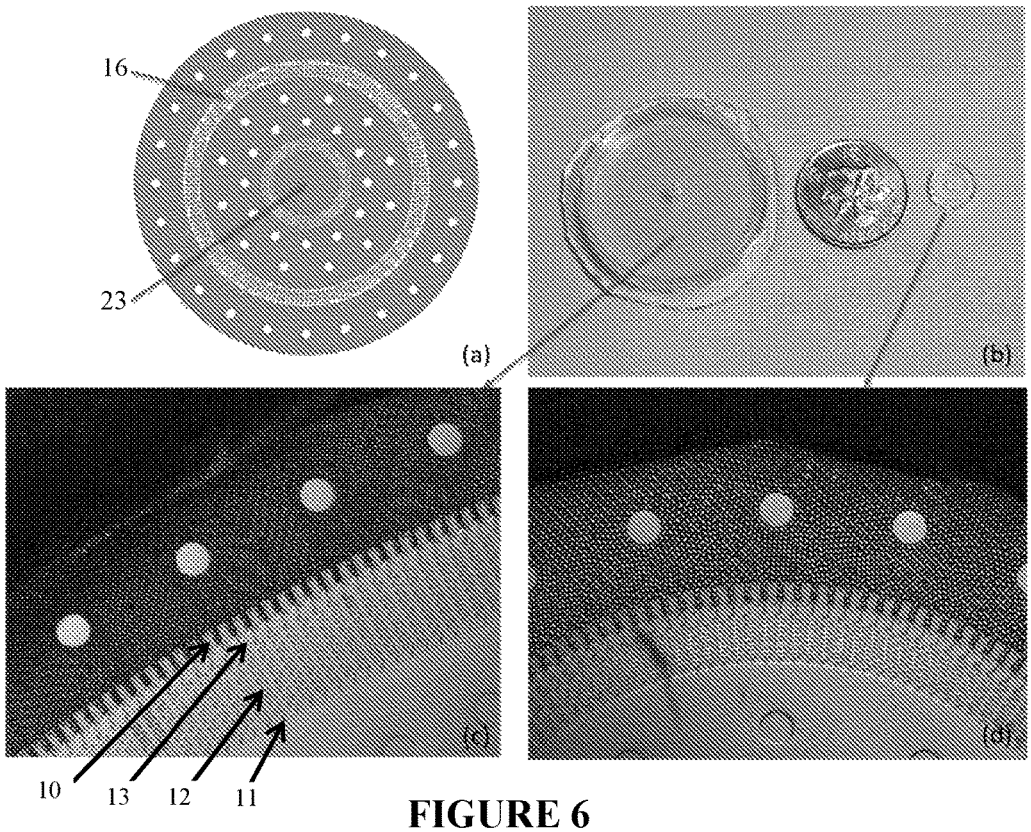
FIG. 6(*a*) is a diagram of HIDS structures forming a circular perimeter in two dimensions according to an embedment of the present invention.

FIG. 6(*a*) is a diagram of circular symmetry integration of HIDS structures in two dimensions according to an embedment of the present invention. The HIDS structures 16 form a perimeter in the shape of a ring that surrounds a dispersed phase pressure source 23. However, a perimeter of any shape (e.g., oval, square, rectangle) can be incorporated. In operation, the dispersed phase fluid flows through the center of the structure and then through each of the channels to form droplets on the outside of the perimeter. A filter may also be placed before the HIDS structures.

FIG. 6(*b*) is an image of two experimental embodiments of the present invention next to a coin, used as a size reference. Both of the experimental embodiments were fabricated using PDMS, but many different materials including polymers, resins, and metals could be used. FIG. 6(*c*) is an image of the experimental embodiment depicted on the left hand side of FIG. 6(*b*) under the microscope. The integrated microdroplet generator of FIG. 6(*c*) has 800 channels, an outside diameter of 42200 μm, a circular perimeter of HIDS structures with a diameter of 37600 μm, 15 μm channel widths, 80 μm channel heights, 2600 μm channel lengths, and was capable of producing 50 μm diameter droplets at a rate of 4 to 12 kHz. Each of the HIDS structures has a blocking rail 10, an inlet channel 11, a middle channel 12, and an outlet channel 13. Furthermore, each of the middle channels 12 includes a series of curves or bends to increase the channel length.

FIG. 6(*d*) is an image of the experimental embodiment depicted on the right hand side of FIG. 6(*b*). The integrated microdroplet generator of FIG. 6(*d*) has 164 channels, an outside diameter of 10600 μm, a circular perimeter of HIDS structures with a diameter of 8000 μm, 15 μm channel widths, 80 μm channel heights, and 2600 μm channel lengths. In practice, this 164-channel HIDS generator was able to generate droplets at a rate of 0.8 to 2.5 kHz (i.e., 5 to 15 Hz per channel).

Figure 7:
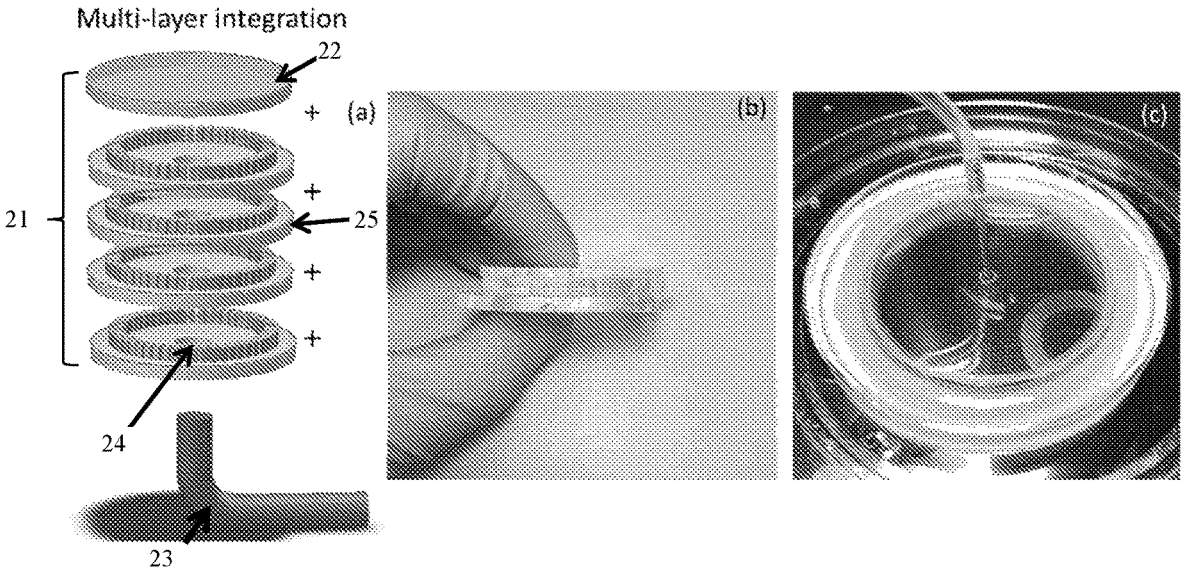
FIG. 7(*a*) is a diagram of an embodiment of the present invention having multi-layer integration of HIDS structures in three dimensions.

FIG. 7(*a*) is a diagram of an embodiment of the present invention having multi-layer integration of HIDS structures. The embodiment shown in FIG. 7(*a*) uses a stack of HIDS structures that are similar to what is shown in FIG. 6(*a*). The multi-layer integrated HIDS structure 21 includes multiple individual stackable HIDS structures 25 with a cap 22 on the top surface. Each of the individual stackable HIDS structures 25 provides a base layer and a perimeter of channels and HIDS droplet structures, and the stackable HIDS structures also mates against the channels of the structure below. A through hole 24 is provided through each of the stackable HIDS structures through which the dispersed phase fluid flows from the dispersed phase fluid source 23. FIG. 7(*b*) is an experimental embodiment of the present invention that integrates 1600 channels in two layers of stackable HIDS structures. FIG. 7(*c*) is an image demonstrating microdroplet formation using the multi-layer integrated HIDS structure depicted in FIG. 7(*b*), having a circular perimeter that is 42 mm in diameter. With one pressure source, operating at 1.0 to 1.4 psi, this double layer HIDS generator was able to produce droplets at a frequency range of 8 to 24 kHz.

The subject invention includes, but is not limited to, the following exemplified embodiments.

Embodiment 1

An apparatus for producing droplets comprising:
a channel; and
a nozzle connected to the channel,
wherein the aspect ratio of the channel is 3.0 or greater.

Embodiment 2

The apparatus of embodiment 1, further comprising a blocking rail that is positioned in front of the nozzle.

Embodiment 3

The apparatus of any of embodiments 1-2, further comprising a supplying rail that is positioned in front of the nozzle,
and a supplying trench formed in a space between the nozzle and the supplying rail.

Embodiment 4

The apparatus for producing droplets of any of embodiments 1-3, wherein the channel includes an inlet channel, an outlet channel, and a middle channel;
wherein the outlet channel is connected to the nozzle; and
wherein the middle channel is between the inlet channel and the outlet channel.

Embodiment 5

The apparatus for producing droplets of any of embodiments 1-4, wherein the outlet channel is perpendicular (or substantially perpendicular) to the nozzle.

Embodiment 6

The apparatus for producing droplets of any of embodiments 4-5, wherein the middle channel includes bends or curves.

Embodiment 7

The apparatus for producing droplets of any of embodiments 1-6, further comprising a filter before the inlet channel inlet.

Embodiment 8

The apparatus for producing droplets of any of embodiments 1-7, wherein the nozzle includes a recess or notch on a side of the outlet channel.

Embodiment 9

The apparatus for producing droplets of any of embodiments 1-8, further comprising a chamber suitable for receiving droplets produced by the channel.

Embodiment 10

The apparatus for producing droplets of any of embodiments 1-9, wherein the apparatus is suitable for producing (or configured to produce) droplets with a diameter in a range of 10 μm to 100 μm.

Embodiment 11

The apparatus for producing droplets of any of embodiments 1-10 wherein the apparatus is suitable for producing (or configured to produce) droplets with a frequency of 0.5 Hz to 50 Hz.

Embodiment 12

The apparatus for producing droplets of any of embodiments 1-11 wherein the aspect ratio of the channel is 4.0 or greater, 5.0 or greater, 6.0 or greater, 7.0 or greater, 8.0 or greater, 9.0 or greater, or 10.0 or greater.

Embodiment 13

An apparatus for producing droplets comprising:
a plurality of HIDS structures, wherein each the of HIDS structures includes a channel and a nozzle,
wherein the aspect ratio of each of the channels is 3.0 or greater.

Embodiment 14

The apparatus of embodiment 13, wherein the HIDS structures form a perimeter suitable for containing (or configured to contain) dispersed fluid and allowing (or configured to allow) dispersed fluid to flow through the HIDS structures.

Embodiment 15

The apparatus of embodiment 13, wherein the HIDS structures form a wall suitable for containing (of configured to contain) a dispersed fluid on one side of the wall and allowing (or configured to allow) it to flow through the HIDS structures.

Embodiment 16

The apparatus of any of embodiments 13-15, further comprising a blocking rail in front of each of the nozzles.

Embodiment 17

The apparatus of any of embodiments 13-16, further comprising a supplying rail and a supplying trench in front of each of the nozzles.

Embodiment 18

The apparatus of any of embodiments 13-17, wherein the HIDS structures are vertically stacked.

Embodiment 19

The apparatus of any of embodiments 13-18 wherein each of the channels includes a middle that has curves or bends.

Embodiment 20

The apparatus of any of embodiments 13-19 further comprising a chamber suitable for collecting droplets that are produced by the HIDS structures.

Embodiment 21

The apparatus of any of embodiments 13-19 further comprising a chamber suitable for receiving droplets produced by the HIDS structures and also suitable for providing a flow of continuous phase fluid to carry away droplets produced by the HIDS structures.

Embodiment 22

The apparatus of any of embodiments 13-21, wherein the apparatus is suitable for producing droplets with a diameter in a range of 15 μm to 40 μm.

Embodiment 23

The apparatus of any of embodiments 13-22, wherein the apparatus is suitable for producing droplets with a frequency of 0.5 Hz to 50 Hz out of each of the channels.

Embodiment 24

The apparatus of any of embodiments 13-23 wherein the aspect ratio of the channels is 4.0 or greater, 5.0 or greater, 6.0 or greater, 7.0 or greater, 8.0 or greater, 9.0 or greater, or 10.0 or greater.

Embodiment 25

A method of producing droplets, the method comprising:

providing a HIDS structure, wherein the HIDS structure includes a channel and a nozzle, and the aspect ratio of the channel is 3.0 or greater; and passing a dispersed fluid through the channel and out of the nozzle such that droplets are formed in a continuous phase fluid.

Embodiment 26

The method of embodiment 25, further comprising providing one or more additional HIDS structures, each having a channel and a nozzle, and wherein an aspect ratio of each of the channels is 3.0 or greater; and passing the dispersed fluid through the channels and out of the nozzles such that droplets are formed in the continuous phase fluid.

Embodiment 27

The method of embodiment 26, wherein the HIDS structures form a perimeter suitable for containing (or configured to contain) the dispersed fluid.

Embodiment 28

The method of embodiment 27, wherein the HIDS structures form a wall suitable for containing (or configured to contain) the dispersed fluid on one side of the wall and allowing (or configured to allow) it to flow through the HIDS structures.

Embodiment 29

The method of any of embodiments 26-28, further comprising providing a blocking rail in front of each of the nozzles that repels droplets away from the nozzle and keeps droplets in the continuous phase from interfering with droplets being produced by the nozzles.

Embodiment 30

The method of any of embodiments 26-29, further comprising providing a supplying rail and a supplying trench in front of each of the nozzles, wherein the continuous phase fluid flows through the supplying trench to fill space between the droplets.

Embodiment 31

The method of any of embodiments 26-30, further comprising providing additional HIDS structures, each having a channel and a nozzle, that are vertically stacked and flowing the dispersed fluid through the additional HIDS structures to form droplets.

Embodiment 32

The method of any of embodiments 26-31 wherein each of the channels includes a middle that has curves or bends.

Embodiment 33

The method of any of embodiments 26-32 further comprising providing a chamber suitable for collecting droplets that are produced by the HIDS structures.

Embodiment 34

The method of any of embodiments 26-32 further comprising providing a chamber suitable for receiving (or configured to receive) droplets produced by the HIDS structures and also suitable for providing (or configured to provide) a flow of continuous phase fluid to carry away droplets produced by the HIDS structures.

Embodiment 35

The method of any of embodiments 26-34, further comprising producing droplets with a diameter in a range of 15 μm to 40 μm.

Embodiment 36

The method of any of embodiments 26-35, further comprising producing droplets out of each of the channels with a frequency of 0.5 Hz to 50 Hz.

Embodiment 37

The method of any of embodiments 26-36 wherein the aspect ratio of the channels is 3.0 or greater, 4.0 or greater, 5.0 or greater, 6.0 or greater, 7.0 or greater, 8.0 or greater, 9.0 or greater, or 10.0 or greater.

Embodiment 38

The method of any of embodiments 33-39, wherein the chamber has the same height (or substantially the same height) as the channels.

Embodiment 39

The method of any of embodiments 33-40, further comprising detaching the chamber from a source of the dispersed fluid and sealing it.

Embodiment 40

The apparatus for producing droplets of any of embodiments 9-13, wherein the chamber has a height that is the same (or substantially the same) as a height of the channel.

Embodiment 41

The apparatus for producing droplets of any of embodiments 1-12 wherein the aspect ratio of the channel is 4.0 or greater, 5.0 or greater, 6.0 or greater, 7.0 or greater, 8.0 or greater, 9.0 or greater, or 10.0 or greater.

It should be understood that the examples and embodiments described herein are for illustrative purposes only and that various modifications or changes in light thereof will be suggested to persons skilled in the art and are to be included within the spirit and purview of this application and the scope of the appended claims. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

1. Anna, S. L., N. Bontoux, and H. A. Stone, Formation of dispersions using "flow focusing" in microchannels. Applied physics letters, 2003. 82(3): p. 364-366.
2. Garstecki, P., et al., Formation of droplets and bubbles in a microfluidic T-junction-scaling and mechanism of break-up. Lab on a Chip, 2006. 6(3): p. 437-446.
3. Nisisako, T. and T. Torii, Microfluidic large-scale integration on a chip for mass production of monodisperse droplets and particles. Lab on a Chip, 2008. 8(2): p. 287-293.
4. Jeong, H.-H., et al., Kilo-scale droplet generation in three-dimensional monolithic elastomer device (3D MED). Lab on a Chip, 2015.
5. Muluneh, M. and D. Issadore, Hybrid soft-lithography/laser machined microchips for the parallel generation of droplets. Lab on a Chip, 2013. 13(24): p. 4750-4754.
6. Kobayashi, I., S. Mukataka, and M. Nakajima, Novel asymmetric through-hole array microfabricated on a silicon plate for formulating monodisperse emulsions. Langmuir, 2005. 21(17): p. 7629-7632.
7. Kobayashi, I., et al., Silicon array elongated through-holes for monodisperse emulsion droplets. American Institute of Chemical Engineers. AIChE Journal, 2002. 48(8): p. 1639.
8. Kobayashi, I., M. Nakajima, and S. Mukataka, Preparation characteristics of oil-in-water emulsions using differently charged surfactants in straight-through microchannel emulsification. Colloids and Surfaces A: Physicochemical and Engineering Aspects, 2003. 229(1): p. 33-41.
9. Kobayashi, I., S. Mukataka, and M. Nakajima, Production of monodisperse oil-in-water emulsions using a large silicon straight-through microchannel plate. Industrial & engineering chemistry research, 2005. 44(15): p. 5852-5856.
10. Sugiura, S., et al., Interfacial tension driven monodispersed droplet formation from microfabricated channel array. Langmuir, 2001. 17(18): p. 5562-5566.
11. Sugiura, S., et al., Characterization of spontaneous transformation-based droplet formation during microchannel emulsification. The Journal of Physical Chemistry B, 2002. 106(36): p. 9405-9409.
12. Kobayashi, I., et al., Microchannel emulsification for mass production of uniform fine droplets: integration of microchannel arrays on a chip. Microfluidics and Nanofluidics, 2010. 8(2): p. 255-262.
13. U.S. Pat. No. 9,162,160—System For Forming An Array Of Emulsions
14. U.S. Patent Application Publication No. 2014/0272996—Droplet Generator With Collection Tube
15. U.S. Patent Application Publication No. 2015/0238965—Monodisperse Microdroplet Generation And Stopping Without Coalescence
16. U.S. Patent Application Publication No. 2008/0014589—Microfluidic Devices And Methods Of Use Thereof
17. U.S. Patent Application Publication No. 2015/0174576—Microfluidic Device For Droplet Generation
18. U.S. Patent Application Publication No. 2006/0120213—Emulsion Process Using Microchannel Process Technology
19. U.S. Patent Application Publication No. 2008/0182910—Process For Forming An Emulsion Using Microchannel Process Technology

We claim:

1. An apparatus for producing droplets comprising:

a channel having an inlet, a middle section, and an outlet having an opening;

a nozzle connected to the outlet of the channel; and a chamber into which the outlet of the channel opens and configured to receive droplets produced by the channel, wherein an aspect ratio of the channel, which is a ratio of a height of the opening of the outlet of the channel to a width of the opening of the outlet of the channel, is 3.0 or greater, such that the height of the opening of the outlet of the channel is at least 3.0 times greater than the width of the opening of the outlet of the channel, wherein a height of the chamber is the same as that of the outlet of the channel, wherein the apparatus further comprises:

a blocking rail that is positioned in front of the nozzle;

a supplying rail that is positioned in front of the nozzle;

a supplying trench formed in a space between the nozzle and the supplying rail; and a filter before the inlet of the channel, wherein the outlet of the channel is angled relative to the nozzle, wherein the outlet of the channel is perpendicular to the nozzle, wherein the nozzle includes a recess or notch on a side of the outlet of the channel, and wherein the chamber is configured to provide a cross flow of continuous phase fluid.

2. The apparatus for producing droplets of claim 1, wherein the middle section of the channel includes bends or curves.

3. The apparatus for producing droplets of claim 1, wherein the apparatus is configured to produce droplets with a diameter in a range of 15 μm to 40 μm or with a frequency of 0.5 Hz to 50 Hz.

4. The apparatus for producing droplets of claim 1, wherein the aspect ratio of the channel is 7.0 or greater, such that the height of the opening of the outlet of the channel is at least 7.0 times greater than the width of the opening of the outlet of the channel.

5. The apparatus for producing droplets of claim 1, wherein the aspect ratio of the channel is 4.0 or greater, such that the height of the opening of the outlet of the channel is at least 4.0 times greater than the width of the opening of the outlet of the channel.

6. The apparatus for producing droplets of claim 1, wherein the aspect ratio of the channel is 5.0 or greater, such that the height of the opening of the outlet of the channel is at least 5.0 times greater than the width of the opening of the outlet of the channel.

7. The apparatus for producing droplets of claim 1, wherein the aspect ratio of the channel is 6.0 or greater, such that the height of the opening of the outlet of the channel is at least 6.0 times greater than the width of the opening of the outlet of the channel.

8. The apparatus for producing droplets of claim 1, wherein the apparatus is configured to produce droplets with a diameter in a range of 15 μm to 40 μm or with a frequency of 0.5 Hz to 50 Hz, and wherein the aspect ratio of the channel is 7.0 or greater, such that the height of the opening of the outlet of the channel is at least 7.0 times greater than the width of the opening of the outlet of the channel.

9. The apparatus for producing droplets of claim 8, wherein the middle section of the channel includes bends or curves.

10. An apparatus for producing droplets comprising: a plurality of a high aspect ratio induced droplet self-breakup structure (HIDS) structures, wherein each HIDS structure of the plurality of HIDS structures comprises:

a channel having an inlet, a middle section, and an outlet having an opening, wherein an aspect ratio of the channel, which is a ratio of a height of the opening of the outlet of the channel to a width of the opening of the outlet of the channel, is 3.0 or greater, such that the height of the opening of the outlet of the channel is at least 3.0 times greater than the width of the opening of the outlet of the channel; and a nozzle connected to the outlet of the channel, wherein the apparatus further comprises a chamber into which the outlet of each channel opens and configured to receive droplets produced by the HIDS structures, wherein a height of the chamber is the same as that of the outlet of each channel, wherein each HIDS structure of the plurality of HIDS structures further comprises:

a blocking rail that is positioned in front of the nozzle; a supplying rail that is positioned in front of the nozzle;

a supplying trench formed in a space between the nozzle and the supplying rail; and a filter before the inlet of the channel, wherein the outlet of each channel is angled relative to the nozzle, wherein the outlet of each channel is perpendicular to the nozzle, wherein each nozzle includes a recess or notch on a side of the outlet of the channel, and wherein the chamber is configured to provide a cross flow of continuous phase fluid.

11. The apparatus of claim 10, wherein the HIDS structures form a perimeter configured to contain dispersed fluid and allow the dispersed fluid to flow through the HIDS structures.

12. The apparatus of claim 11, wherein the HIDS structures form a wall configured to contain the dispersed fluid on one side of the wall and allow it to flow through the HIDS structures.

13. The apparatus of claim 10, wherein the HIDS structures are vertically stacked.

14. The apparatus of claim 10, wherein the middle section of each of the channels has curves or bends.

15. The apparatus of claim 10, wherein the chamber is configured to provide the cross flow of continuous phase fluid to carry away droplets produced by the HIDS structures.

16. The apparatus of claim 15, wherein the apparatus is configured to produce droplets with a diameter in a range of 15 μm to 40 μm or with a frequency of 0.5 Hz to 50 Hz out of each of the channels.

17. The apparatus of claim 16, wherein the aspect ratio of each channel is 7.0 or greater, such that the height of the opening of the outlet of each channel is at least 7.0 times greater than the width of the opening of the outlet of said channel.

18. A method of producing droplets, the method comprising:

providing the apparatus according to claim 1; and passing a dispersed fluid through the channel and out of the nozzle such that droplets are formed in a continuous phase fluid.

* * * * *